United States Patent [19]

Pramanick

[11] Patent Number: 5,025,235

[45] Date of Patent: Jun. 18, 1991

[54] MICROSTRIPLINE INTERDIGITAL PLANAR FILTER

[75] Inventor: Protap Pramanick, Cambridge, Canada

[73] Assignee: Com Dev Ltd., Cambridge, Canada

[21] Appl. No.: 343,801

[22] Filed: Apr. 27, 1989

[30] Foreign Application Priority Data

Feb. 9, 1989 [CA] Canada ..... 590567

[51] Int. Cl.[5] ..... H01P 1/203

[52] U.S. Cl. ..... 333/204; 333/203; 333/246

[58] Field of Search ..... 333/202–205, 333/219, 219.1, 222, 223, 238, 246, 234

[56] References Cited

U.S. PATENT DOCUMENTS

| | | | |
|---|---|---|---|
| 3,579,152 | 5/1971 | Moore | 333/204 X |
| 4,418,324 | 11/1983 | Higgins | 333/205 X |
| 4,578,656 | 3/1986 | Lacour et al. | 333/204 |
| 4,638,271 | 1/1987 | Jecko et al. | 333/235 X |

FOREIGN PATENT DOCUMENTS

| | | | |
|---|---|---|---|
| 0131327 | 6/1978 | Fed. Rep. of Germany | 333/238 |
| 0172001 | 10/1983 | Japan | 333/202 |
| 0126301 | 7/1984 | Japan | 333/204 |
| 0043902 | 2/1987 | Japan | 333/204 |
| 0254501 | 11/1987 | Japan | 333/204 |
| 0263702 | 11/1987 | Japan | 333/204 |

OTHER PUBLICATIONS

Wong, "Microstrip Tapped-Line Filter Design", IEEE Trans. on Microwave Theory & Techniques, vol. MTT-27, No. 1, Jan. 1979, pp. 44–50.

*Primary Examiner*—Eugene R. LaRoche
*Assistant Examiner*—Seung Ham
*Attorney, Agent, or Firm*—Daryl W. Schnurr

[57] ABSTRACT

A microstripline interdigital planar filter has a number of microstripline coupled resonators in an inhomogeneous medium consisting a soft dielectric substrate, and a high dielectric constant, high Q ceramic superstrate. The resonators are printed on the soft substrate as thick copper strips. The rectangular shaped, silver-coated aluminum housing dimensions are chosen so as to give the highest available unloaded Q factor of the resonators. The high dielectric constant of the superstrate is chosen so as to give a very small resonator length resulting in a very small filter size. The input and the output ports are located at right tapping points on the two outermost resonators. The tapping points are chosen so as to match the loaded Q factor of the filter. Previous filters are physically larger and cannot achieve the same high level of performance characteristics as filters of the present invention.

11 Claims, 2 Drawing Sheets

MICROSTRIPLINE INTERDIGITAL PLANAR FILTER

BACKGROUND OF THE INVENTION

1. Field of the Invention

This invention relates to a planar filter of microwave signal bands in a microstripline. More particularly, this invention relates to an interdigital filter having a superstrate and a substrate, the superstrate having a high dielectric constant and a high Q.

2. Description of the Prior Art

In mobile communication systems, numerous cellular telephones at the 800 MHz band have been put into practical use and, recently, the demand for hand-held cellular type mobile communication sets has been increasing. In terms of size, loss and cost reduction of known filters, antenna filters and RF stage filters are the most important RF passive components. Filters using dielectric resonators have the greatest advantage based on cost and physical size. However, such dielectric resonator filters are still expensive and the resonators must have a very high dielectric constant. Previous filters are more expensive to manufacture, are too large in size and are incapable of producing the same level of advantageous results as produced by filters of the present invention.

SUMMARY OF THE INVENTION

It is an object of the present invention to provide a planar microstripline filter which has a relatively small size and has superior performance characteristics to previous dielectric resonator filters for cellular telephone applications. More specifically, it is an object of the present invention to provide a planar filter which has a high unloaded Q and low loss when compared to previous filters.

A microstripline interdigital planar filter has a housing containing a dielectric substrate having a moderate dielectric constant. A plurality of microstrip resonators are located on the substrate in the form of a metal pattern, all resonators of said filter being located in a common plane. There is a cover for the metal pattern that is spaced apart from said metal pattern when mounted on said housing to create a space therebetween. A dielectric superstrate of a size and thickness to completely cover said resonators and to fill said space is located between the metal pattern and said cover. The superstrate is ceramic having a high dielectric constant and a high Q. The filter has an input and output.

DESCRIPTION OF A PREFERRED EMBODIMENT

Figure 1:
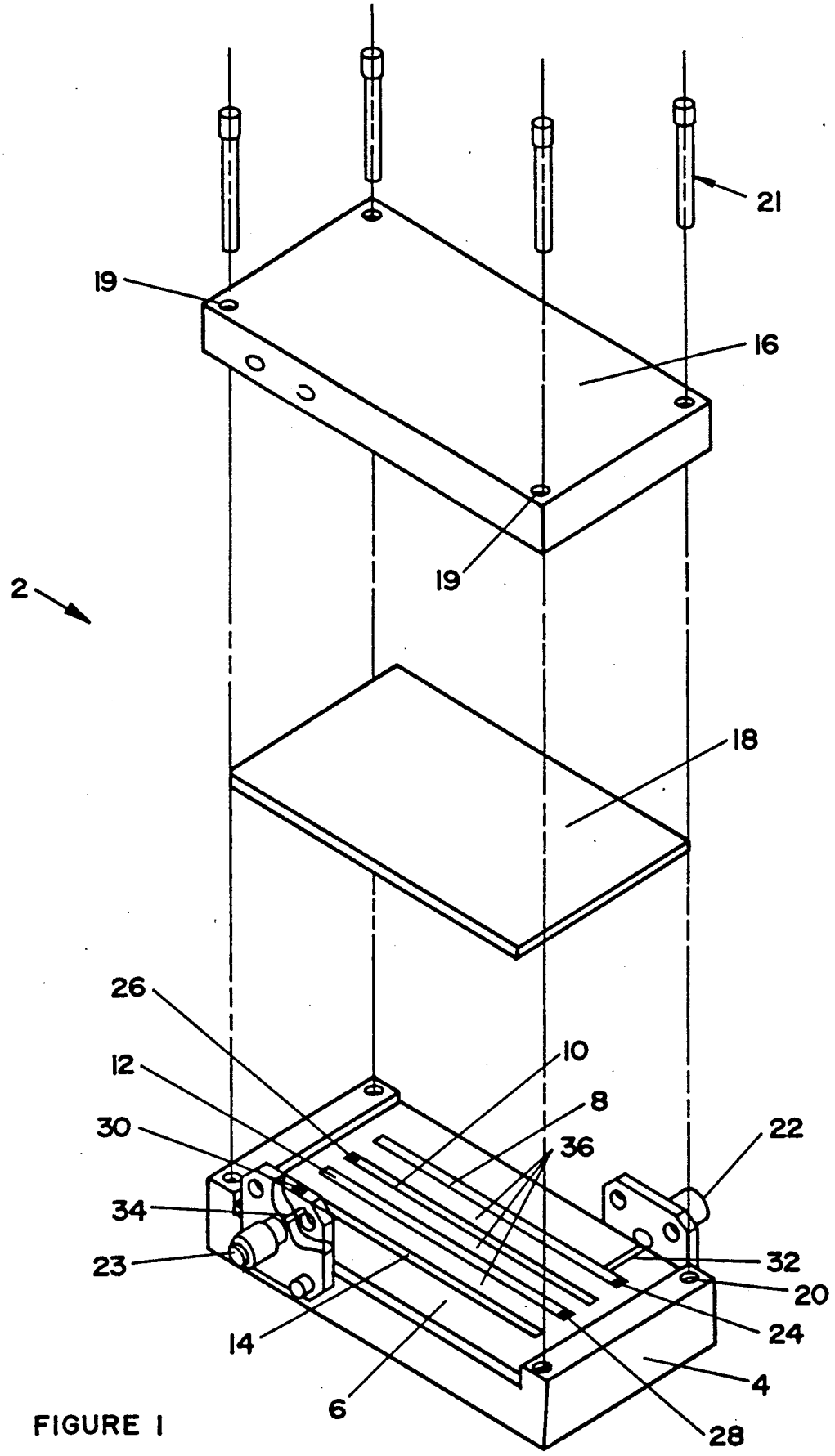
FIG. 1 is an exploded perspective view of a 4-pole tapped line interdigital planar filter.

Referring to the drawings in greater detail, in FIG. 1, there is shown a 4-pole Chebyshev filter 2 having a housing 4 containing a dielectric substrate 6. A plurality of microstrip resonators 8, 10, 12, 14 are located on the substrate 6 in the form of a metal pattern. A cover 16 for the metal pattern is designed to be spaced apart from the metal pattern when mounted on said housing 4 to create a space therebetween. A dielectric superstrate 18 is of a size and thickness to fill said space and is located between the metal pattern and the cover 16. The cover 16 has four openings 19 that correspond to openings 20 on the housing 4. Screws 21 fit within the openings 19, 20 to hold the cover 16 tightly on the housing 4. The filter has an input 22 and an output 23.

Preferably, the dielectric substrate 6 is made of soft material and the resonators 8, 10, 12, 14 are printed in strips on said substrate. Alternatively, the metal pattern can be created on the substrate using backside metalization soldered to a metal carrier. Alternate ends of the four resonators 8, 10, 12, 14 are shorted to ground by means of plated through via holes 24, 26, 28, 30 respectively.

Energy is coupled into the first resonator 8 through the tapping microstripline 32 extending between the input 22 and said resonator 8. Energy is then coupled out of the first resonator 8 and into the second resonator 10. Energy is then coupled out of the second resonator 10 and into the third resonator 12. Energy is then coupled out of the third resonator 12 and into the fourth and last resonator 14. Energy is coupled out of the last resonator 14 through a tapping microstripline 34 to the output 23. The resonators 8, 10, 12, 14 are parallel to one another. Energy is coupled between adjacent resonators through capacitive coupling that is determined by the size of a gap 36 between immediately adjacent resonators.

The input 22 is located on one side of the filter 2 and the output 23 is located on an opposite side of the filter 2. Both the input and output are located at right tapping points on the first and last resonators 8, 14. The tapping points are chosen to match the loaded Q factor of the filter 2 so that a maximum level of energy can be transferred into and out of said filter.

Preferably, the substrate is made of ceramic-filled polystyrene-type material and the superstrate is made of ceramic material. Since the substrate and the superstrate do not have the same dielectric constant, the filter is said to have an inhomogeneous medium. The substrate 6 has a moderate dielectric constant with a maximum value of ten. The superstrate has a high dielectric constant and high Q, the dielectric constant ranging from twenty to one hundred. Preferably, each resonator is chosen to produce a high Q factor. A high Q factor results from resonators having an increased thickness and an increased width. While the filter shown in the drawings is a 4-pole Chebyshev filter, the number of resonators and, therefore, the order of the filter can be varied within reason, as desired. Preferably, the housing 4 is made of silver-coated aluminum as is the cover 16. The filter 2 has an advantage over previous filters in that the increase in overall dielectric constant of the filter allows a decrease in the wavelength and therefore a decrease in the length of the resonators. The ceramic superstrate is a hard material and the filter has an advantage in that no etching is required on the superstrate. The substrate is preferably made of a soft plastic material and the soft characteristics allow the resonators to be printed directly onto the substrate. The material for the resonators is preferably copper. If a hard substrate were used, the material for the resonators would be gold and would be much more expensive and much more difficult to work with. For tuning purposes, the copper resonators, once created, can be precisely shortened to the desired length. The fact that no etching is required on the hard superstrate and the resonators are located on the soft substrate makes the filter ideally suited for cost effective or low cost mass production. Post production tuning can be readily accomplished by trimming the resonators to a shorter length. It is important that the superstrate be sized to fill what would otherwise be a gap between the cover and the housing.

Figure 2:
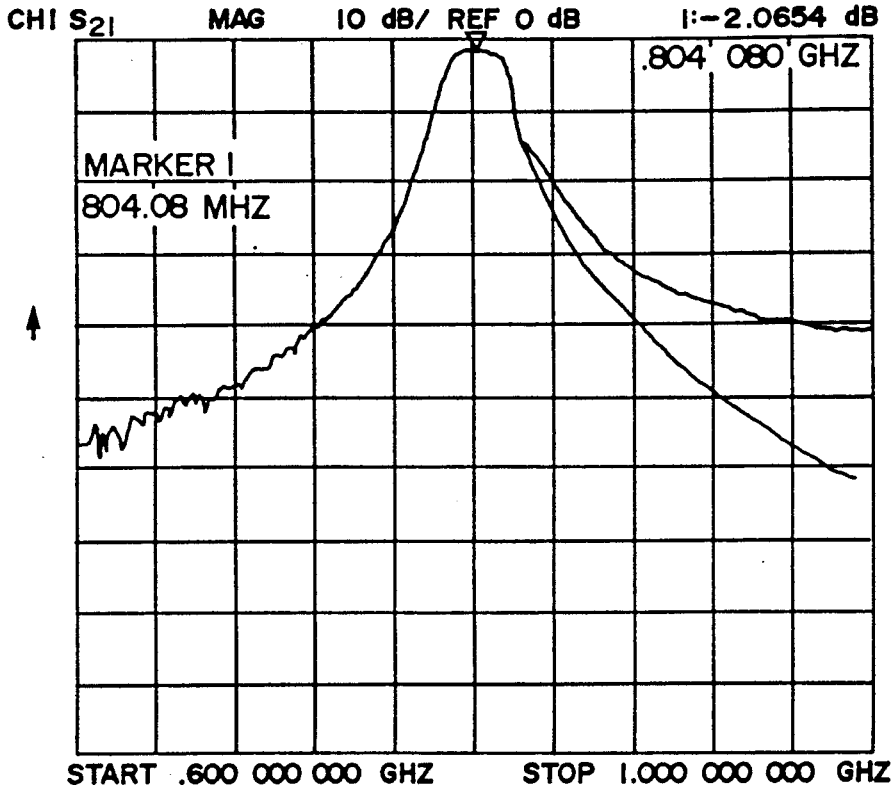
FIG. 2 is a graph showing the isolation response for the filter shown in FIG. 1.
Figure 3:
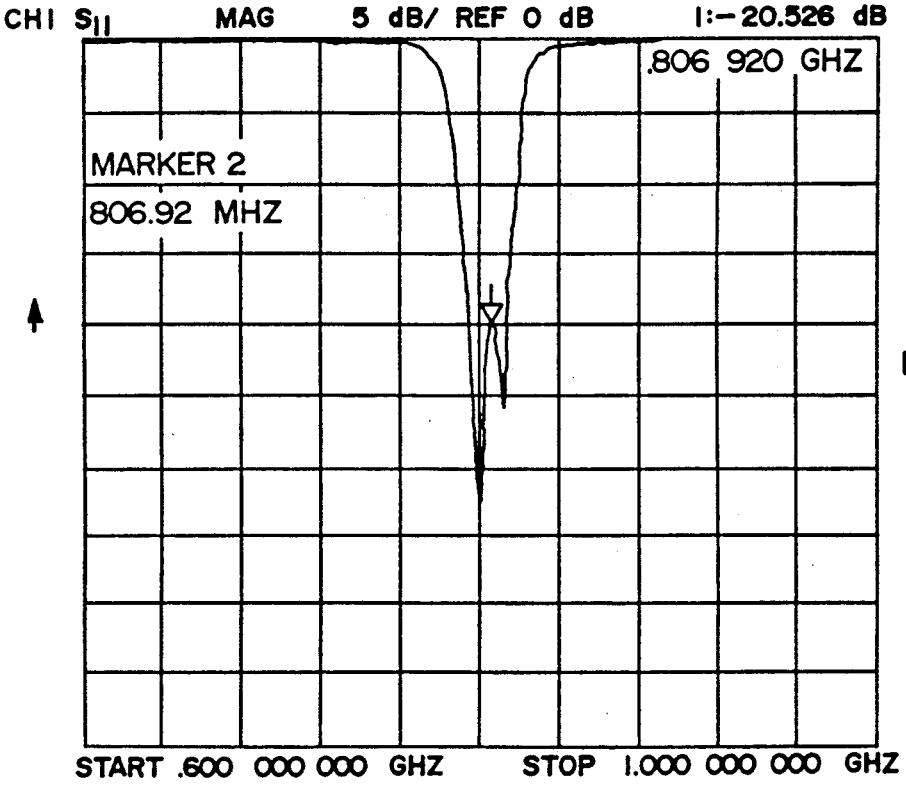
FIG. 3 is a graph showing the return loss response of the filter shown in FIG. 1.

From FIGS. 2 and 3, it can be seen that the filter can produce a high isolation response or high Q factor with little loss.

What I claim as my invention is:

1. A microstripline interdigital planar filter comprising a housing containing a dielectric substrate having a moderate dielectric constant, a plurality of microstrip resonators being located on said substrate in the form of a metal pattern, all resonators of said filter being located in a common plane a cover for the metal pattern, said cover being spaced apart from said metal pattern when mounted on said housing to create a space therebetween, a dielectric superstrate of a size and thickness to completely cover said resonators and to fill said space being located between the metal pattern and said cover, said superstrate is ceramic having a high dielectric constant and a high Q, said filter having an input and output.

2. A filter as claimed in claim 1 wherein the dielectric substrate is made of soft material and the resonators are printed in strips on said substrate.

3. A filter as claimed in claim 2 wherein the resonators resonate at a same quasi TEM mode simultaneously, said resonator being arranged so that coupling occurs into and out of each resonator consecutively in an order in which the resonators are located across the filter, said coupling commencing from the input to a first resonator located nearest to said input and ending with a last resonator located nearest to said output.

4. A filter as claimed in claim 3 wherein all of the resonators are located parallel to one another and coupling is achieved through capacitive coupling determined by a size of a gap between immediately adjacent resonators.

5. A filter as claimed in claim 4 wherein the size and thickness of each metal strip of each resonator is chosen to produce a high Q factor, a high Q factor resulting from increasing a width of each resonator and from increasing a thickness of each resonator.

6. A filter as claimed in claim 5 wherein the filter is a Chebyshev filter with four resonators.

7. A filter as claimed in claim 6 wherein alternate ends of the resonators are shorted to ground by means of plated through via holes with edges located at alternate ends.

8. A filter as claimed in claim 7 wherein the input and output are located at either side of the filter at right tapping points on the first and last outermost resonator respectively.

9. A filter as claimed in claim 8 wherein the substrate is made of ceramic-filled polystyrene-type material.

10. A filter as claimed in claim 9 wherein the housing is made of silver-coated aluminum.

11. A filter as claimed in claim 10 wherein the microstripline resonators are made of copper.

* * * * *